United States Patent [19]

Wilkins et al.

[11] Patent Number: 4,934,270

[45] Date of Patent: Jun. 19, 1990

[54] LOW ENERGY FUSE MULTI-CONNECTOR

[75] Inventors: Clive F. Wilkins, Kyalami; William A. Jones, Glen Marais, both of South Africa

[73] Assignee: AECI Limited, Transvaal, South Africa

[21] Appl. No.: 253,598

[22] Filed: Oct. 5, 1988

[30] Foreign Application Priority Data

Oct. 15, 1987 [ZA] South Africa ..... 87/7754

[51] Int. Cl.[5] ..... F42C 5/00; F42C 9/14

[52] U.S. Cl. ..... 102/265; 102/266; 102/269; 102/224

[58] Field of Search ..... 137/625.12, 625.47, 137/627; 102/265, 266, 269, 224

[56] References Cited

U.S. PATENT DOCUMENTS

| | | | |
|---|---|---|---|
| 944,026 | 12/1909 | Fowden | 137/625.12 X |
| 1,015,164 | 1/1912 | Fowden | 137/625.12 X |
| 1,674,333 | 6/1928 | Johnson | 102/269 X |
| 2,335,085 | 11/1943 | Roberts | 137/625.12 X |
| 2,389,000 | 11/1945 | Roberts | 137/625.12 X |
| 3,985,058 | 10/1976 | Corrado et al. | 102/224 X |

*Primary Examiner*—Arnold Rosenthal

*Attorney, Agent, or Firm*—Cushman, Darby & Cushman

[57] ABSTRACT

A multiconnector whereby a primary length of low energy fuse can be connected to a selected number of secondary lengths of low energy fuse has an inlet port into which an end of the primary length can be inserted and a number of outlet ports into which ends of secondary lengths of fuse can be inserted. The outlet ports and the inlet port communicate via internal passages. The outlet port may be closed by removable plugs or rupturable membranes so that those outlet ports that are not used do not establish a communication path between the inlet port and the atmosphere or the multiconnector may have two parts that are relatively displaceable so that the number of outlet ports that communicate with the inlet port can be set by relative displacement of the two parts.

13 Claims, 2 Drawing Sheets

LOW ENERGY FUSE MULTI-CONNECTOR

THIS INVENTION relates to a multiconnector for low energy fuse.

By a "multiconnector" is meant a device whereby several lengths of low energy fuse may be connected to one another, so that a shock wave in one may be transferred to all the others to be passed therealong.

The low energy fuse may comprise a length of tubing that is partly filled with an explosive composition. One form of such low energy fuse is known by the registered trademark "Nonel".

According to a first aspect of the invention there is provided a multiconnector for low energy fuse, which includes a body that defines an inlet port wherein an end of a length of initiating fuse is receivable and a plurality of outlet ports wherein ends of a desired number of lengths of secondary fuse that is less than or equal to the number of outlet ports, are receivable, there being a passageway between all of the outlet a closing means for each outlet port for closing off each outlet port, each closing means being functional to provide a communication path, in use, between the initiating and secondary fuse, so that any number of outlet ports may be utilised as desired and those outlet ports that are not used remain closed off.

It will be appreciated that the closing means may be removable, openable, frangible, rupturable, or the like.

Thus, the closing means may be a membrane in or at the entrance to each outlet port, that is broken or ruptured by an end of the secondary fuse as it is inserted or a special tool prior to insertion of the secondary fuse; a removable plug; or a valve element that is opened by the end of the secondary fuse.

According to a second aspect of the invention there is provided a multiconnector for low energy fuse, which includes a body that defines an inlet port wherein an end of a length of initiating fuse is receivable and a plurality of outlet ports wherein ends of a desired number of lengths of secondary fuse, that is less than or equal to the number of outlet ports, are receivable;

a selective communication path establishing means for establishing a communication path between the inlet port and only those outlet ports which are selected to receive secondary fuses.

The communication path establishing means may comprise a path defining means for defining a communication path between the inlet port and each of the selected outlet ports. Conveniently, the path defining means may include two relatively displaceable parts, each having the same number of passages as there are outlet ports, with the number of passages in the two parts that communicate with one another being variable by suitably displacing the two parts. The inlet port may be provided in one of these parts and the outlet ports in the other. Thus, the part that has the outlet ports has a number of passages, there being a passage for and in communication with each port, and the number of passages in communication with the inlet port is variable by relative displacement of the parts.

The passages in one part may be formed by channels in a surface of that part which are closed by a complementary surface of the second part. A detent means may be provided to assist in aligning one or more of the passages of one part with one or more of the passages of the other part.

The inlet port may be substantially in line with the outlet ports. Thus, the outlet ports may be adjacent to or parallel to one another, with the inlet port being parallel to and longitudinally spaced from the outlet ports. Thus, the entrances to the outlet ports through which the ends of fuse are inserted may all face in one direction, and the entrance to the inlet port faces in an opposed direction. Thus a shock wave from ion.

The invention is now described, by way of examples, with reference to the accompanying drawings, in which.

Figure 3:
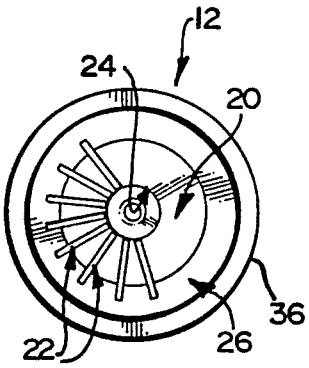
FIG. 3 shows a view from below of the first part.
Figure 2:
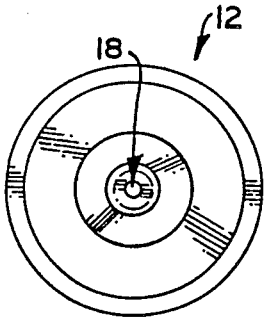
FIG. 2 shows a view from above of the first part.
Figure 1:
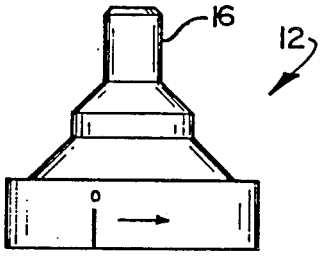
FIG. 1 shows a side view of a first part of a first embodiment of a multiconnector in accordance with the invention.
Figure 5:
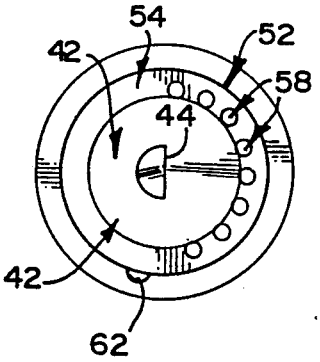
FIG. 5 shows a view from above of this second part.
Figure 6:
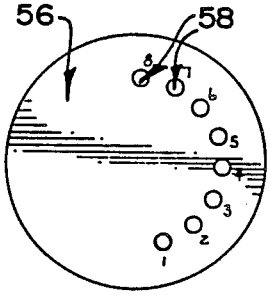
FIG. 6 shows a view from below of this second part.
Figure 4:
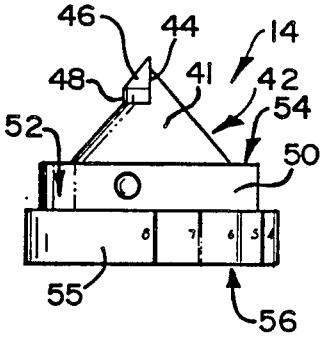
FIG. 4 shows a side view of a second part of the first multiconnector.

Referring to FIGS. 1 to 7, a first embodiment of a multiconnector in accordance with the invention is designated generally by reference numeral 10. The multiconnector 10 is formed from a first part 12 and a second part 14.

Figure 7:
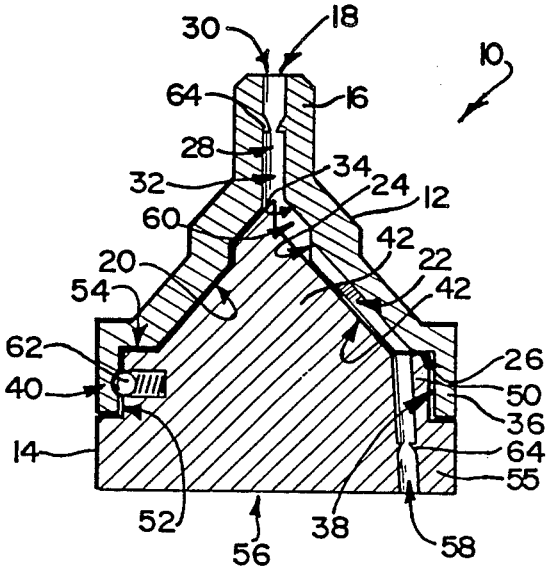
FIG. 7 shows a sectioned view of the first connector.

The first part 12 is substantially funnel shaped having a tubular end portion 16 which is hollow to define an inlet port a tubular end portion 16 which is hollow to define an inlet port 18 and has an internal frusto-conical surface 20. In the surface 20 there are eight channels 22 which extend longitudinally from one end of the frusto-conical surface 20 to the other. Thus, the channels 22 open out at one end in a circular cylindrical surface 24 and at their other ends in a planar annular surface 26. As is clearly seen in FIG. 3, the channels 22 are distributed over half the frusto-conical surface 20 and are evenly spaced. Further, the port 18 is defined by a passage 28 in the tubular portion 16 which extends from its entrance end 30 to an inner end 32 that merges with the circular cylindrical surface 24 via a further frusto-conical surface 34. Finally, a skirt 36 extends from the annular surface 26 and defines an internal circular cylindrical surface 38. In this circular cylindrical surface 38 there are nine recesses 40 of which one is shown in FIG. 7.

The second part 14 has a portion 41 that defines a conical surface 42 with a protruberance 44 at its tip. The protruberance 44 has a half conical end portion 46 and a semi-cylindrical portion 48. The portion 46 is complementary to the frusto-conical portion 44 of the first part and the semi-cylindrical portion 48 is complementary to the circular cylindrical surface 24 of the first part 12. The conical surface 42, in turn, is complementary to the frusto-conical surface 20 of the first part 12.

The second part 14 has a further portion 50 which has a circular cylindrical outer surface 52 that is wider than the 42 merges with the cylindrical surface 50 via a planar annular surface 54. The annular surface 54 is complementary to the annular surface 26 and the circular cylindrical surface 50 is complementary to the circular cylindrical surface 38.

The second part 14 has a further portion 55 by means of which it is manipulated. The portion 55 has an outer face 56.

The second part 14 is receivable in the first part 12, with the two parts being relatively rotatable.

As is seen most clearly in FIG. 7, eight passages 58 extend through the portions 50 and 55, opening out in the surface 54 and the outer face 56. The passages 58 are spaced in a similar manner to the channels 52, so that the parts 12 and 14 may be relatively rotated to bring each of the channels 22 into alignment and register with a passage 58. It will further be appreciated that by rotating the parts 12 and 14 relative to one another, that none of the passages 58 may be in alignment and communication with any of the channels 22, one passage 58 may be in alignment and communication with one of the channels 22, two of the passages 58 may be in communication and alignment with two of the channels 22, and so on. Thus, by rotating the parts 12 and 14 relative to one another, a desired number of the passages 58 is brought into communication and alignment with the same number of channels 22.

It will further be appreciated that the conical surface 42 of the second part 14 closes off the channels 22 so that they form passages. The passages so formed communicate with the passage 28 via a chamber 60 defined between the protuberance 44 and a portion of the frusto-conical surface 34 and the circular cylindrical surface 24 of the first part 12. This chamber in turn communicates with the passage 28 which defines the inlet port 18. The passages 58 define outlet ports.

In order to facilitate alignment of the channels 22 and the passages 58, the second part 14 is provided with a spring loaded detent ball 62 that seats in the recesses 40, the recesses 40 being suitably arranged.

Finally, gripping formations 64 are provided in the passage 28 and the passages 58 to grip the ends of length of fuse inserted in the ports.

It will accordingly be appreciated that an end of a length of initiating fuse is inserted in the port 18 and a desired number of secondary fuses have their ends inserted in the upper outlet ports 58, these ports being numbered to indicate the appropriate ports that are to be used. The ports 12 and 14 are relatively rotated so that the appropriate passages 58 are in alignment with channels 22. A shock wave from the initiating fuse will then pass through the passage 28, through the chamber 60, through the appropriate channels 22, through the appropriate passages 58 and initiate the secondary fuses therein. The inner ends of the channels 22 that are not being used are closed off by the surface 54.

It will finally be noted that the inlet port 18 is substantially in line with the outlet ports 58, the entrances to these ports, through which the fuses are inserted, facing in opposite directions.

Figure 8:
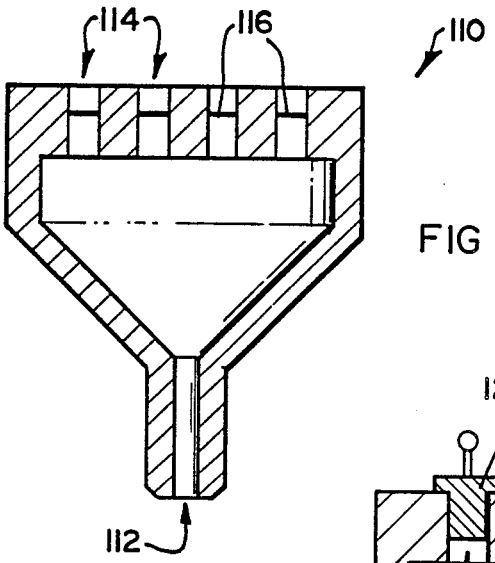
FIG. 8 shows a schematic sectioned view of a second embodiment of a multiconnector in accordance with the invention.

Referring now to FIG. 8, a second embodiment of a multiconnector in accordance with the invention is designated generally by reference numeral 110. This multiconnector 110 has an inlet port 112 and four outlet ports 114. The outlet ports 114 are closed by rupturable membranes 116 which are sufficiently strong to withstand, in use, a shock wave and yet may be pierced either by a length of fuse or by a separate tool.

Figure 9:
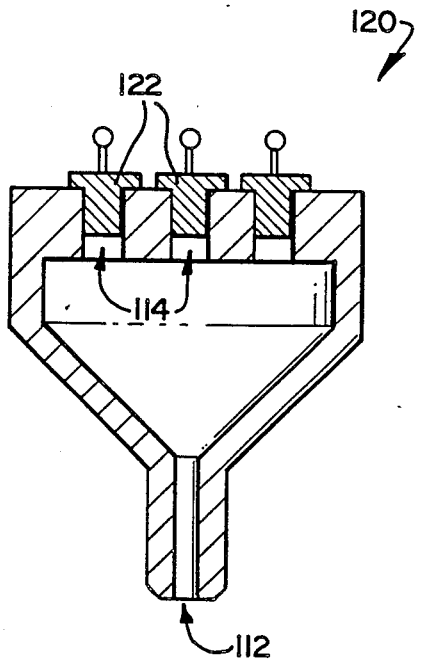
FIG. 9 shows a schematic sectioned view of a third embodiment of a multiconnector in accordance with the invention.

Referring to FIG. 9, a third embodiment of a multiconnector in accordance with the invention is designated generally by reference numeral 120. This embodiment 120 is similar to the embodiment 110 except that the outer ports 114 are closed by removable plugs 122. Thus, in use, the appropriate plugs 122 are removed and lengths of tube inserted into the open outlet ports 114 that result.

Figure 10:
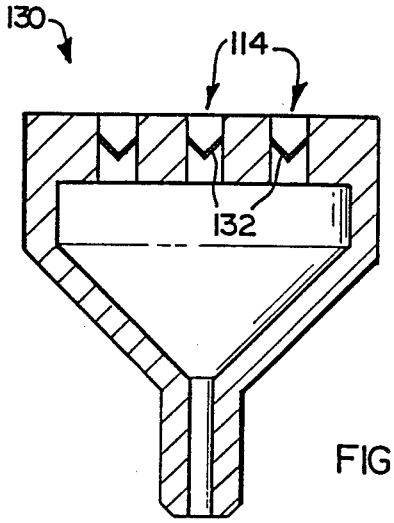
FIG. 10 shows a schematic sectioned view of a fourth embodiment of a multiconnector in accordance with the invention.

Referring finally to FIG. 10, a fourth embodiment of a multiconnector in accordance with the invention is designated generally by reference numeral 130. This embodiment 130 is similar to the embodiment 110 shown in FIG. 8, except that the outlet ports 114 have diaphragm-like closure elements 132. These elements 132 are dilated by lengths of fuse (not shown) that are pushed into the outlet ports 114. The elements 132 are conical and extend into the multiconnector 130, away from the entrances to the ports 114.

By means of the invention a multiconnector is provided whereby a shock wave in an initiating low energy fuse may be transferred to a desired number of secondary fuses.

What is claimed is:

1. A multiconnector for low energy fuse, which includes a body that defines an inlet port wherein an end of a length of initiating fuse is receivable and a plurality of outlet ports wherein ends of a desired number of lengths of secondary fuse that is less than or equal to the number of outlet ports, are receivable, there being a passageway between all of the outlet ports and the inlet port; and a closing means for each outlet port for closing off each outlet port, each closing means being functional to provide a communication path, in use, between the initiating and secondary fuse, so that any number of the outlet ports may be utilized as desired, and those outlet ports that are not used remain closed off, said body, inlet and outlet ports and passageway and closing means being such that a shockwave from the initiating fuse positioned in said inlet port is transferred only to desired secondary fuses positioned in selected outlet ports.

2. The multiconnector of claim 1, in which each closing means comprises a frangible membrane.

3. The multiconnector of claim 1, in which each closing means comprises a removable plug.

4. The multiconnector of claim 1, in which each closing means comprises a valve element that is openable by an end of secondary fuse.

5. The multiconnector of claim 1, in which the outlet ports are aligned with the inlet port.

6. A multiconnector for low energy fuse, which includes a body that defines an inlet port wherein and end of a length of initiating fuse is receivable and a plurality of outlet ports wherein ends of a desired number of lengths of secondary fuse, that is less than or equal to the number of outlet ports, are receivable.

a selective communication path providing means for establishing a communication path between the inlet port and only those outlet ports which are selected to receive secondary fuses, said body, inlet and outlet ports, path and closing means being such that a shockwave from the initiating fuse positioned in said inlet port is transferred only to desired secondary fuses positioned in selected outlet ports.

7. The multiconnector of claim 6, in which the selective communication path establishing means comprises a path defining means for defining a communication path between the inlet port and each of the selected outlet ports.

8. The multiconnector of claim 7, in which the path defining means includes two relatively displaceable parts, each having the same number of passages as there are outlet ports, with the number of passages in the two parts that communicate with one another being variable by suitably displacing the two parts.

9. The multiconnector of claim 6, in which the body comprises two parts, one of which has the inlet port and the other of which has the outlet ports.

10. The multiconnector of claim 8, in which the passages in one of the parts are defined by channels in that part and which are closed off by a surface of the other part.

11. The multiconnector of claim 8 which includes a detent means for holding the two parts in a number of predetermined relative positions.

12. The multiconnector of claim 6, in which the inlet port and the selected outlet ports are aligned.

13. A multiconnector for low energy fuse, which includes a body that defines an inlet port which includes an end of a length of initiating fuse and a plurality of outlet ports which include ends of a desired number of lengths of secondary fuse that is less than or equal to the number of outlet ports, there being a passageway between all of the outlet ports and the inlet port; and a closing means for each outlet port for closing off each outlet port, each closing means being functional to provide a communication path, in use, between the initiating and secondary fuses, so that any number of the outlet ports may be utilized as desired, and those outlet ports that are not used remain closed off, said body, inlet and outlet ports, passageway and closing means being such that a shockwave from the initiating fuse positioned in said inlet port is transferred only to desired secondary fuses positioned in selected outlet ports.

* * * * *